US006745847B2

(12) United States Patent
Kim

(10) Patent No.: US 6,745,847 B2
(45) Date of Patent: Jun. 8, 2004

(54) FIRE EXTINGUISHING SPRAY NOZZLE

(75) Inventor: Jong Jin Kim, Masan (KR)

(73) Assignee: WIN Co., Ltd., Kimhae (KR)

( * ) Notice: Subject to any disclaimer, the term of this patent is extended or adjusted under 35 U.S.C. 154(b) by 0 days.

(21) Appl. No.: 10/266,532

(22) Filed: Oct. 8, 2002

(65) Prior Publication Data

US 2003/0150623 A1 Aug. 14, 2003

(30) Foreign Application Priority Data

Feb. 8, 2002 (KR) ..... 2002-7236

(51) Int. Cl.[7] ..... A62C 37/08; A62C 35/00; B05B 1/26; B05B 1/14; B05B 1/00

(52) U.S. Cl. ..... 169/37; 169/16; 239/500; 239/504; 239/520; 239/559; 239/600

(58) Field of Search ..... 169/37, 16, 5, 169/14; 239/500, 504, 520, 559, 600, 524, 556, 589

(56) References Cited

U.S. PATENT DOCUMENTS 2,749,183 A * 6/1956 Fraser ..... 239/460
4,989,675 A * 2/1991 Papavergos ..... 169/14
5,769,327 A 6/1998 Kure et al.

* cited by examiner

*Primary Examiner*—Michael Mar
*Assistant Examiner*—Darren Gorman
(74) *Attorney, Agent, or Firm*—Notaro & Michalos P.C.

(57) ABSTRACT

A fire extinguishing spray nozzle connected to a vertical pipeline includes a nozzle body with a plurality of micro apertures formed on a lower inner circumference thereof, and a nozzle cap connected to the nozzle body and having a guide line and orifices. The orifices of the nozzle cap communicate with a chamber formed between the nozzle body and nozzle cap, so that water supplied from the vertical pipeline flows to the orifices through a guide line. The nozzle body has a female threaded portion on an inner circumference of a connecting line, and the nozzle cap has a male threaded portion on a protruded portion thereof, so that the nozzle cap is threadedly engaged to the nozzle body.

2 Claims, 8 Drawing Sheets

FIRE EXTINGUISHING SPRAY NOZZLE

BACKGROUND OF THE INVENTION

1. Field of the Invention

The present invention relates to a fire extinguishing spray nozzle, and more particularly, to a fire extinguishing spray nozzle capable of effectively overcoming fires by generating water fog through micro apertures of an end of a nozzle.

2. Background of the Prior Art

In general, ships are provided under the ceiling thereof with a number of fire extinguishing spray nozzles for preventing a flame from being spread and extinguishing fires.

According to the fire extinguishing spray nozzle, in case of fire, water is supplied from a water tank through a horizontal pipe and a manifold to a vertical pipeline. And then, the water is sprayed from several apertures formed on an end of the spray nozzle connected to the vertical pipeline.

The conventional fire extinguishing spray nozzle cannot extinguish fires caused by oil or gas using water spray. Although the fires can be extinguished using halon gas or carbon dioxide gas, since these gases are harmful to the human body, fire officers have to be evacuated for safety. In addition, since the halon gas or carbon dioxide gas also are harmful to appliances, the operation of a heating, ventilation and air conditioning system has to be interrupted, and a main engine and the power have to be shut off.

In order to overcome the above problems, a nozzle for spreading and generating water fog is disclosed in U.S. Pat. No. 5,769,327, issued to Kure. According to the Kure patent, at least two channels converge and collide at a point outside of the nozzle, which comprises an attachment for connection with a water conduit. The attachment is provided with a support surface for a nozzle head. The nozzle head is provided with at least one support surface cooperating with the support surface of the attachment. The discharge orifices are boated at the support surfaces between the head and the attachment.

The point of collision is determined with exact precision by the mutual angle of the channels, but it is difficult to precisely machine a plurality of the channels on the support surface of the head. Therefore, the cost of manufacturing the above nozzle is increased.

SUMMARY OF THE INVENTION

Accordingly, the present invention is directed to a fire extinguishing spray nozzle that substantially obviates one or more problems due to limitations and disadvantages of the prior art.

It is an object of the present invention to provide a fire extinguishing spray nozzle capable of effectively extinguishing fires using water fog generated by a pressure difference and collision of water particles passing water through micro apertures of an end of a nozzle.

It is another object of the present invention to provide a fire extinguishing spray nozzle capable of being easily manufactured.

In order to accomplish the above objects, the present invention provides a fire extinguishing spray nozzle connected to a vertical pipeline, the spray nozzle comprising: a nozzle body with a plurality of micro apertures formed on a lower inner circumference thereof, and a nozzle cap connected to the nozzle body and having a guide line and orifices, wherein the orifices of the nozzle cap are communicated with a chamber formed between the nozzle body and the nozzle cap, so that water supplied from the vertical pipeline flows to the orifices through the guide line.

The spray nozzle is further connected to a tank for storing a nitrogen gas, and is supplied with the water and the nitrogen gas.

The water and the nitrogen gas are mixed in the chamber, and are discharged outwardly from the micro apertures at a high pressure to form water fog.

The nozzle body has a female threaded portion formed on an inner circumference of a connecting line, and the nozzle cap has a male threaded portion formed on a protruded portion thereof, so that the nozzle cap is threadly engaged to the nozzle body.

According to another aspect of the present invention, there is provided a fire extinguishing spray nozzle connected to a vertical pipeline, the spray nozzle comprising: a nozzle body having a connecting line; a nozzle cap connected to the nozzle body and having a guide line and orifices; and a coupling member with a plurality of micro apertures formed on a lower inner circumference thereof and interposed between the nozzle body and the nozzle cap, wherein the orifices of the coupling member are communicated with a chamber formed between the nozzle body and the coupling member, so that water supplied from the vertical pipeline flows to the orifices through the guide line.

The nozzle body has a female threaded portion formed on an inner circumference of the connecting line, and the nozzle cap has a male threaded portion formed on a protruded portion thereof, so that the nozzle cap is threadly engaged to the nozzle body.

It is to be understood that both the foregoing general description and the following detailed description of the present invention are exemplary and explanatory and are intended to provide further explanation of the present invention as claimed.

BRIEF DESCRIPTION OF THE DRAWINGS

The accompanying drawings, which are included to provide a further understanding of the present invention and are incorporated in and constitute a part of this application, illustrate embodiment(s) of the present invention and together with the description serve to explain the principle of the present invention. In the drawings.

DETAILED DESCRIPTION OF THE PREFERRED EMBODIMENTS

Reference will now be made in detail to a preferred embodiment of the present invention.

Figure 1:
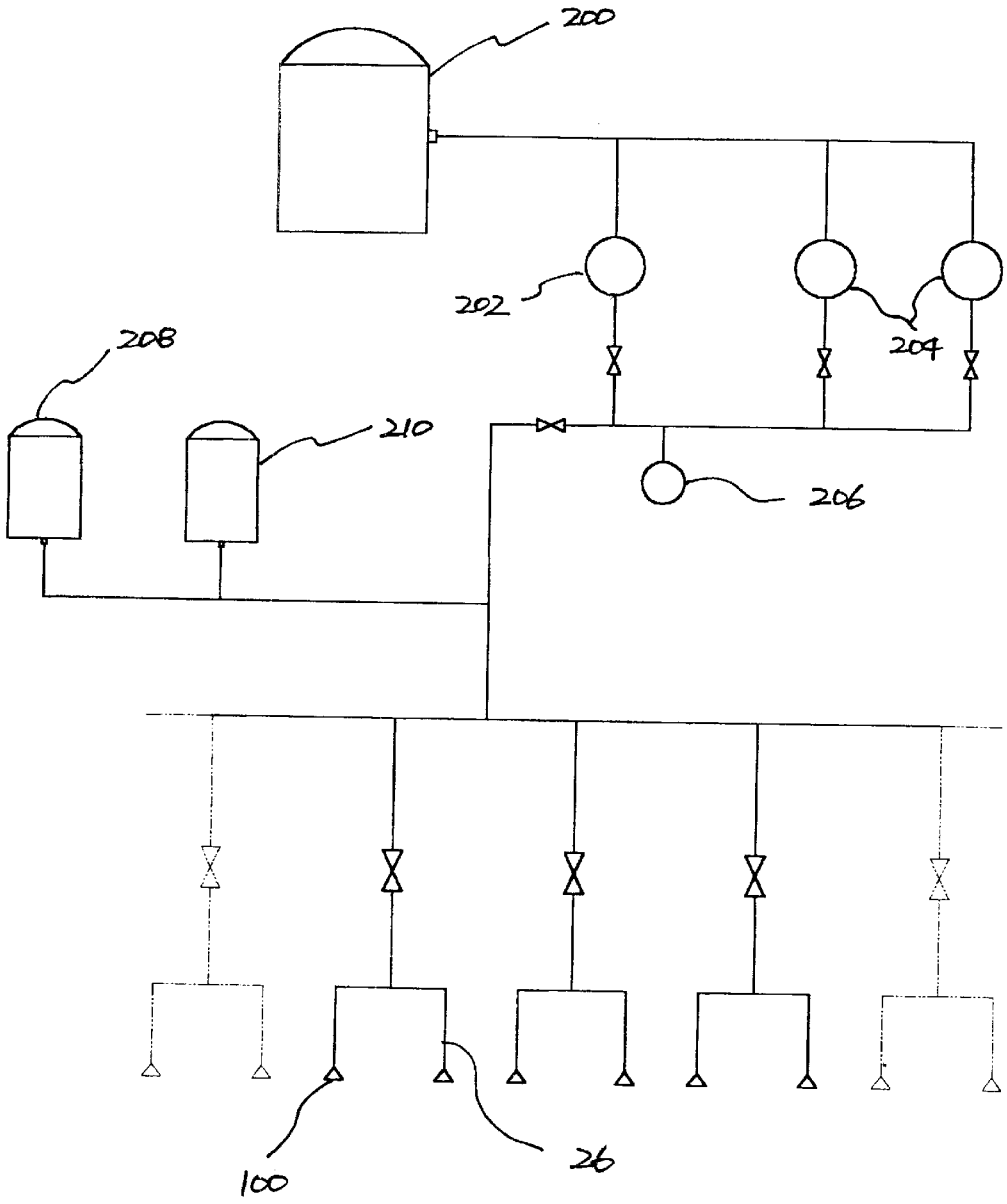
FIG. 1 is a perspective view of a fire extinguishing system of the present invention.

FIG. 1 is a diagram of the construction of a fire extinguishing system according to the present invention. The fire extinguishing system comprises a first water tank 200 filled with water to be used when extinguishing fires, a first pump 202 for increasing a pressure of the water filled in the first water tank 200 up to 35 bar, and a second pump 204 for increasing a risen pressure of the water more than 70 bar.

A pressure switch 206 is located between the first pump 202 and the second pump 204 for regulating the pressure of the pumps.

The fire extinguishing system further comprises a nitrogen tank 208 filled with nitrogen. The nitrogen serves as a medium of increasing a pressure in a spray nozzle to a positively necessary pressure, i.e., 100 bar, suitable for generating a water fog 24 at the spray nozzle 100.

In addition, a second water tank 210 is connected to the nitrogen tank 208 for serving as a lubricant so that the nitrogen flows smoothly in a pipeline.

The water, a hydraulic pressure of which is risen to a pressure of 100 bar, flows through a manifold to the spray nozzle 100, so that it passes through micro apertures 14 to generate the water fog 24.

Figure 2:
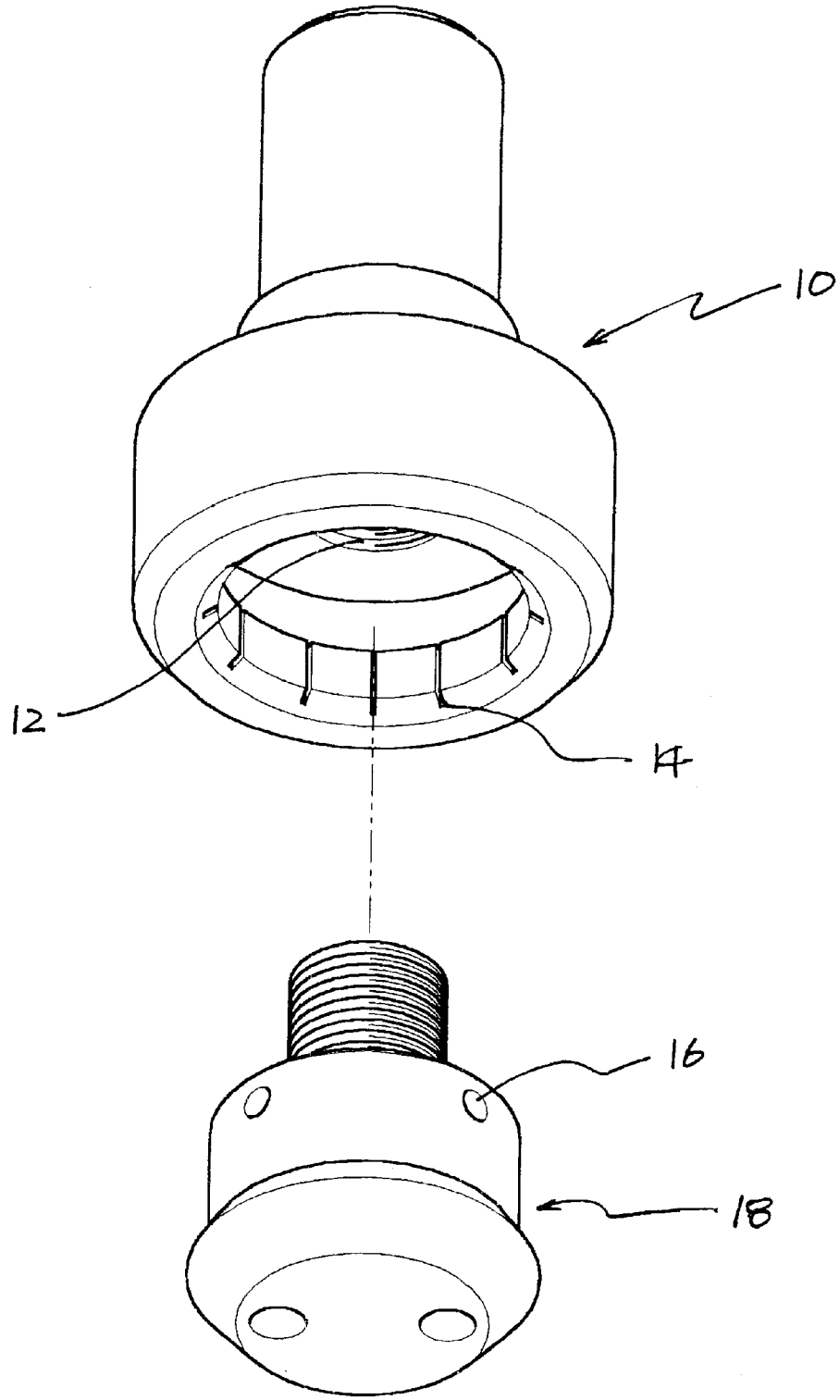
FIG. 2 is a perspective view illustrating the construction of a spray nozzle according to one preferred embodiment of the present invention.
Figure 3A:
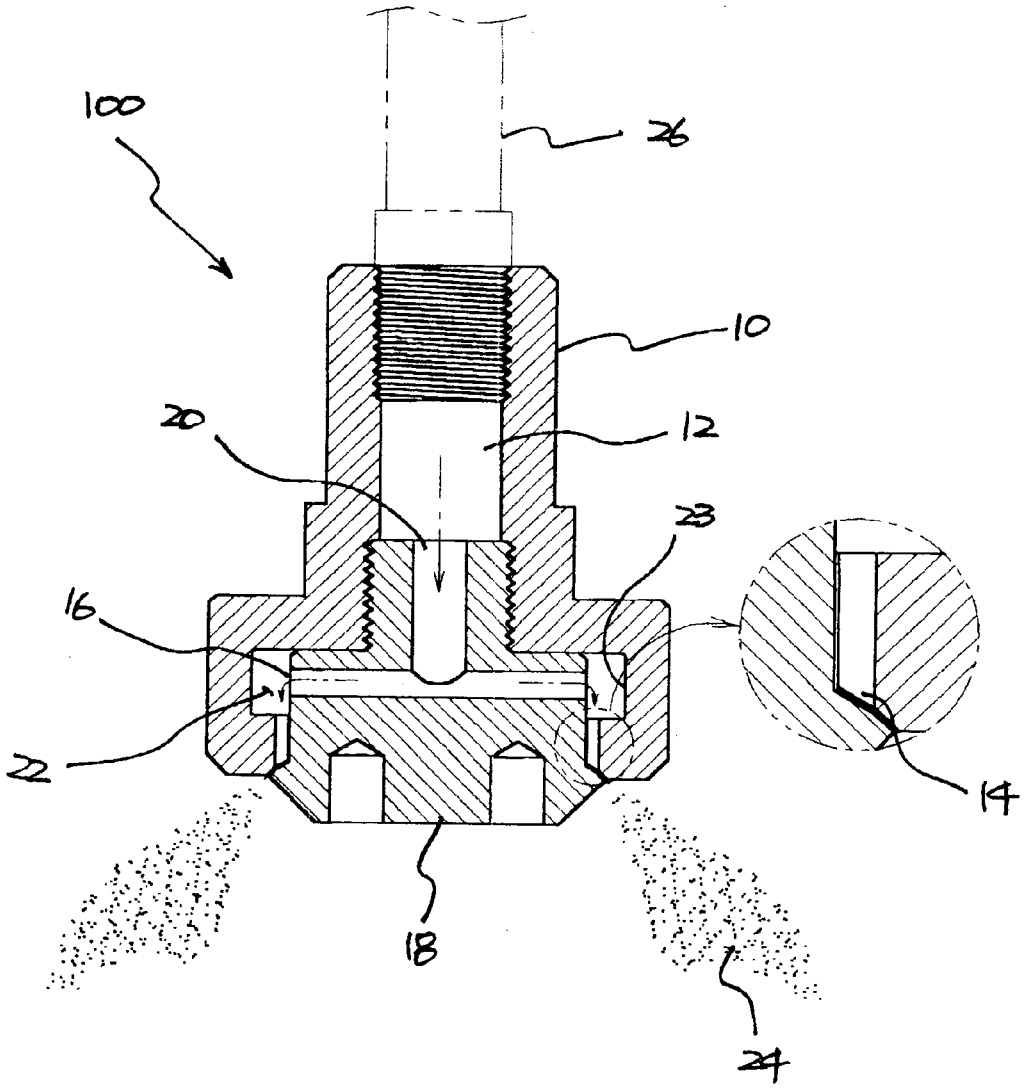
FIGS. 3*a* and 3*b* are cross sectional views of the spray nozzle in FIG. 2.
Figure 3B:
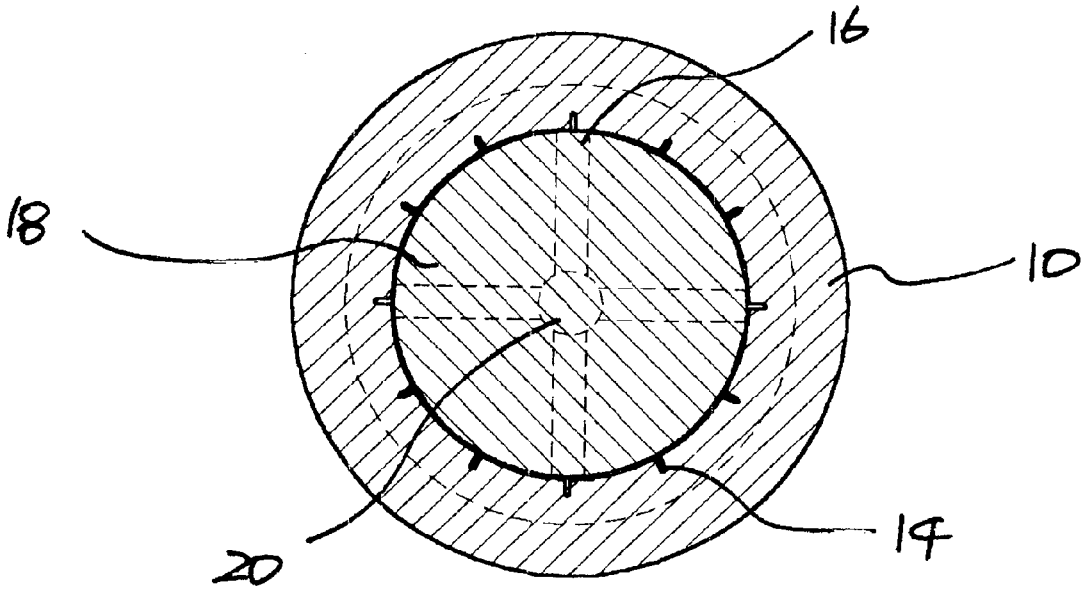

FIGS. 2 and 3 are views illustrating the detailed construction of the spray nozzle according to one preferred embodiment of the present invention. The spray nozzle 100 includes mainly a body 10 and a nozzle cap 18. A connecting line 12 is formed in the nozzle body 10, and is fastened to a vertical pipeline 26 shown in FIG. 1. The micro apertures 14 are formed along an inner circumference of the nozzle body 10.

A guide line 20 is formed in the nozzle cap 18, so that the water pressurized to 100 bar is guided to orifices 16 formed in at least 4 directions around the nozzle cap 18.

The orifice 16 is communicated with the guide line formed in the nozzle cap 18, so as to strongly spray the water into a chamber 22 formed between the nozzle body 10 and the nozzle cap 18.

At that time, the water sprayed primarily from the orifice 16 collides with an end 23 of the nozzle body 10, so that particles of the water are broken finely. The following nitrogen gas passes through the orifices 16 to collide with the previously broken particles of water and so more breaking of the particles of water occurs.

In order to prevent a phenomenon in that the particles are mixed to form large particles, the particles are eddied in the chamber 22, thereby causing the particles to be expanded.

After that, the mixtures expanded in the chamber 22 pass through the micro apertures 14 in the nozzle body 10. The particles of water are more broken due to the high-pressure discharge, and are radially sprayed in the atmosphere through the micro apertures 14 in a shape of water fog 24.

The nozzle body has a female threaded portion formed on an inner circumference of a connecting line, and the nozzle cap has a male threaded portion formed on a protruded portion thereof, so that the nozzle cap is threadly engaged to the nozzle body.

Figure 4:
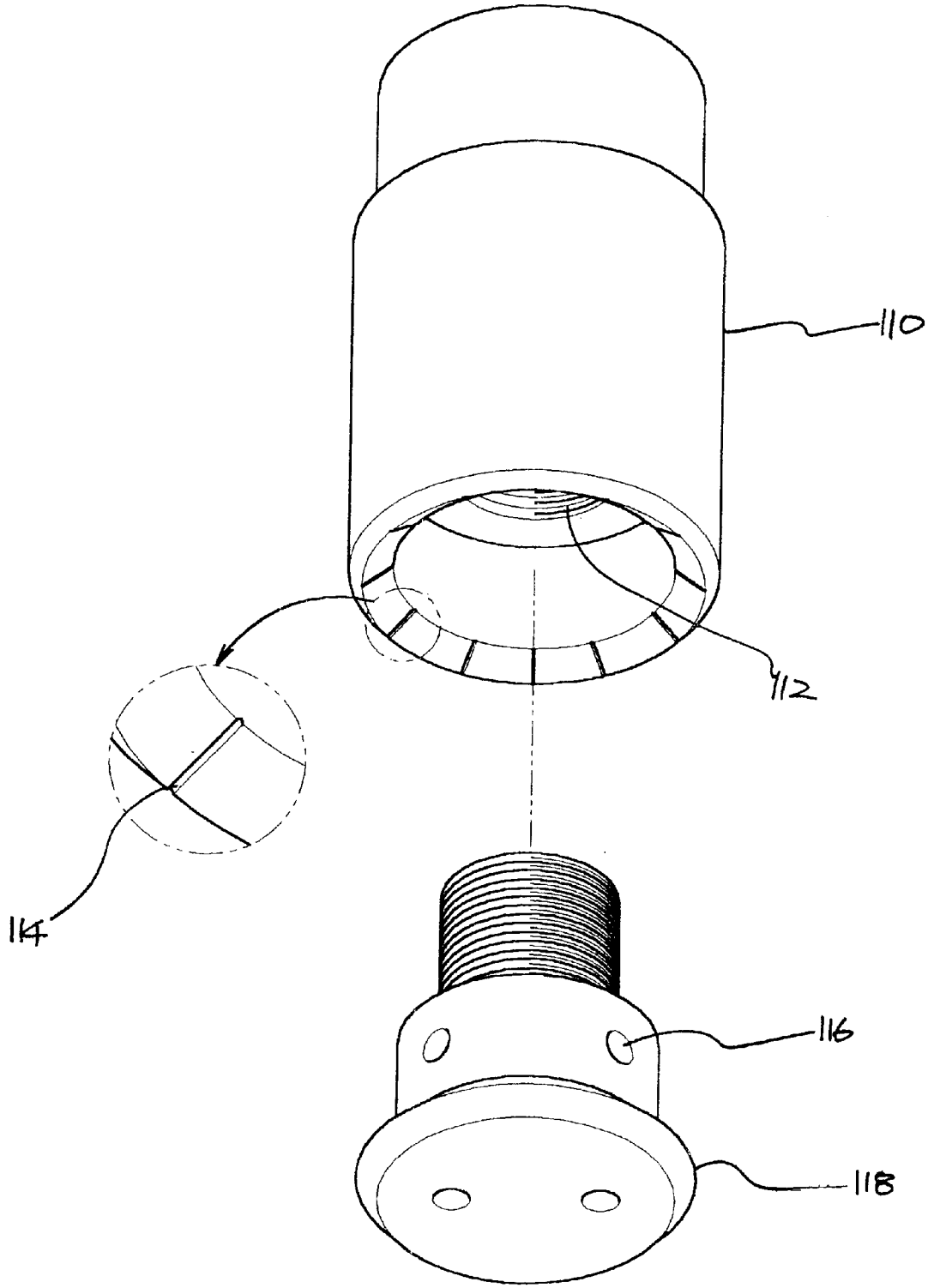
FIG. 4 a perspective view illustrating the construction of a spray nozzle according to another preferred embodiment of the present invention.
Figure 5:
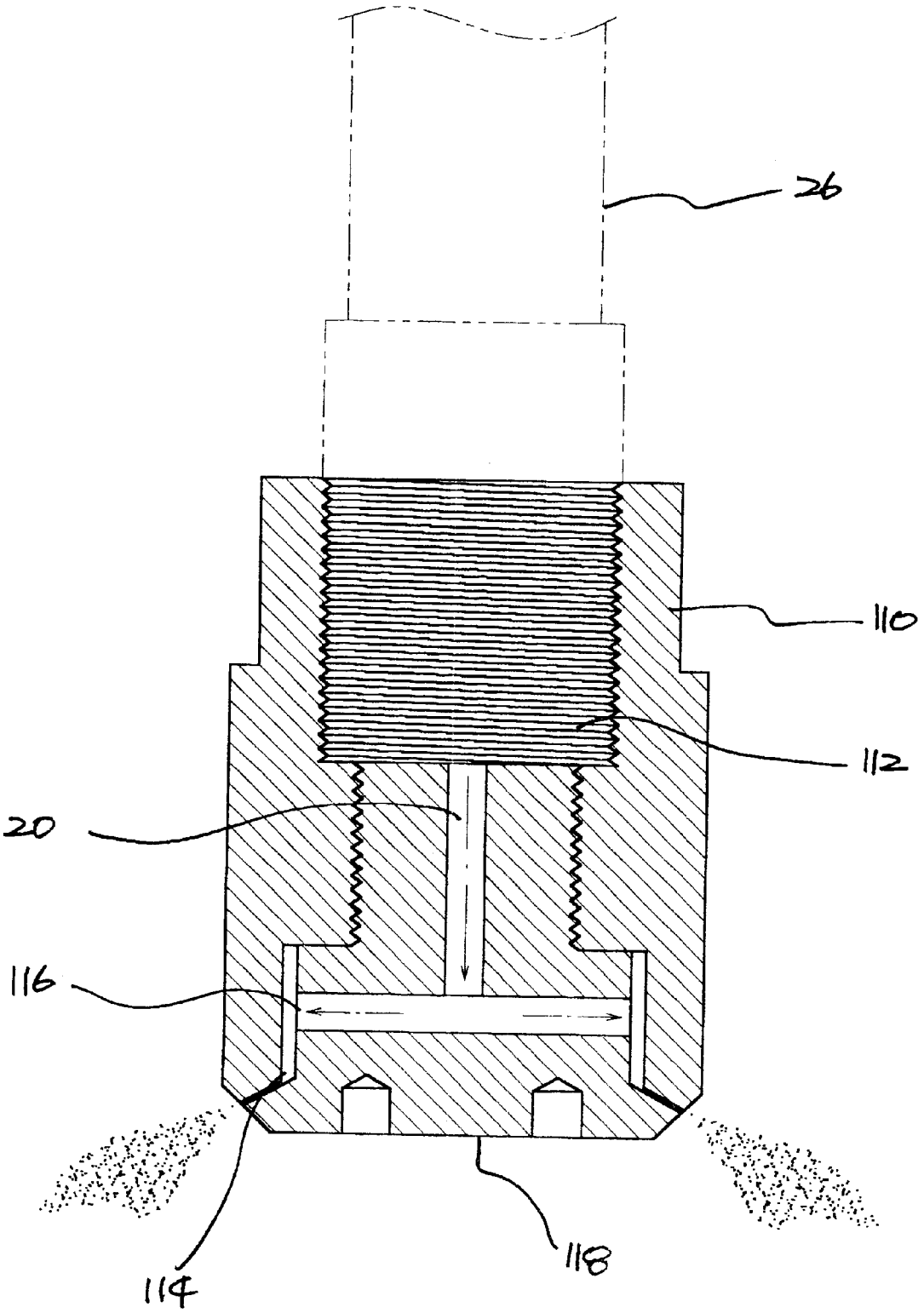
FIG. 5 is a cross sectional view of a detailed construction of FIG. 4.

FIGS. 4 and 5 show another embodiment of the fire distinguishing spray nozzle of the present invention.

The fire extinguishing spray nozzle shown in FIGS. 4 and 5 is divided into a nozzle body 110 and a nozzle cap 118. A connecting line 112 and micro apertures 114 are formed in the nozzle body 110, and a guide line 120 is formed in the nozzle cap 118 and is connected to orifices 116.

The water and nitrogen gas flow through the orifices 116 into a chamber 122 of the nozzle body 110, and the mixtures are eddied in the chamber 122, thereby causing the particles to be expanded. The mixtures expanded in the chamber 122 pass through the micro apertures 14 in the nozzle body 110 at a high pressure, thereby being radially sprayed in the atmosphere in shape of water fog 24.

Figure 6:
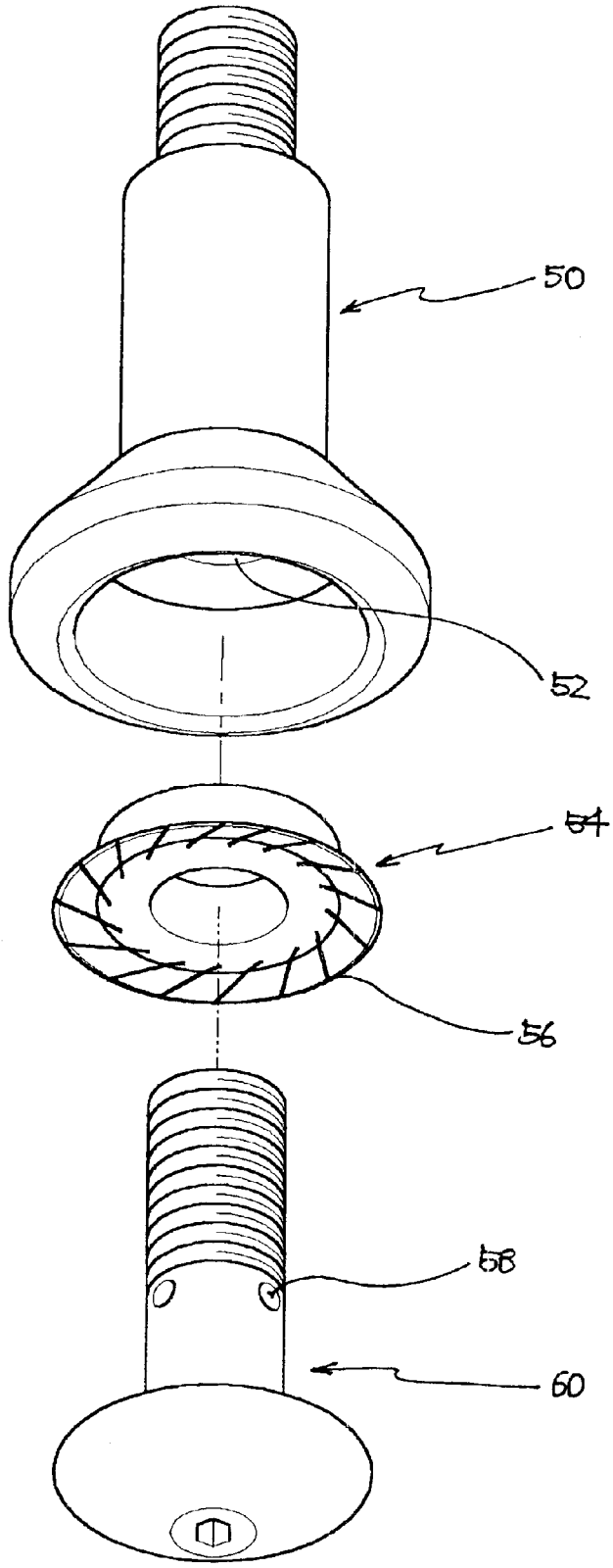
FIG. 6 is a perspective view illustrating the construction of a spray nozzle according to a further preferred embodiment of the present invention.
Figure 7:
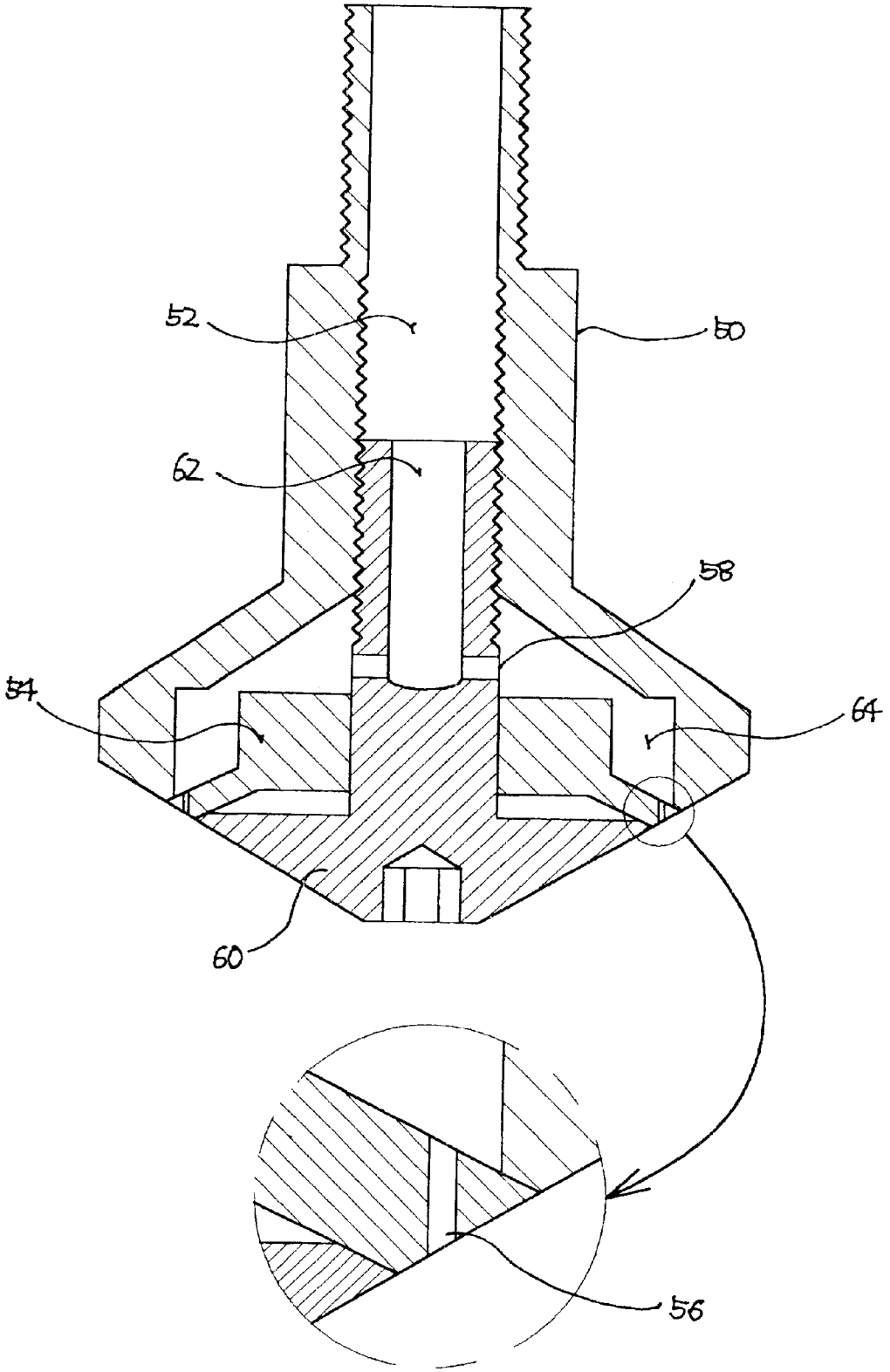
FIG. 7 is a cross sectional view of a detailed construction of FIG. 6.

FIGS. 6 and 7 show a further embodiment of the fire extinguishing spray nozzle of the present invention. A nozzle cap 60 is fastened to a bottom of a nozzle body 50, and is formed with orifices 58 in four directions. The nozzle body has a connecting line 52. A coupling member 54 is interposed between the nozzle body 50 and the nozzle cap 60. A plurality of micro apertures 56 are formed in an outer circumference of the coupling member 54. The coupling member 54 is provided in a center thereof with an opening for receiving the nozzle cap 60.

The operation of the fire extinguishing spray nozzle constructed as described above will now be described.

The water supplied from a pressurized tank (not shown) passes through a guide line 62 formed in the nozzle cap 60, and then passes through the orifices 58 having a smaller diameter than that of the guide line 62, thereby generating a pressure difference and thus finely breaking the particles of water. In addition, the particles of water are eddied in a chamber 64, and are sprayed from the micro apertures 56 formed in the coupling member 54, thereby being radially sprayed in the atmosphere in a shape of water fog.

Since the coupling member 54 is interposed between the nozzle body 50 and the nozzle cap 60, the micro apertures 56 can be easily formed in the coupling member 50. In addition, an alien substance inserted into the micro apertures can be easily removed.

With the construction as described above, since the water passes through the orifices at a high pressure, the pressure difference and the collision of the particles of water cause the grain size thereof to be minimized. The water is mixed with the nitrogen gas, and is expanded within the chamber. The mixtures pass through the micro apertures formed in an end of the nozzle to generate the water fog. Therefore, the present invention may effectively extinguish fires produced due to oil or gas, as well as overcoming solid fires.

The forgoing embodiments are merely exemplary and are not to be construed as limiting the present invention. The present teachings can be readily applied to other types of apparatuses. The description of the present invention is intended to be illustrative, and not to limit the scope of the claims. Many alternatives, modifications, and variations will be apparent to those skilled in the art.

What is claimed is:

1. A fire extinguishing spray nozzle connected to a vertical pipeline, the spray nozzle comprising:

a nozzle body having a connecting line;

a nozzle cap connected to the nozzle body and having a guide line and orifices;

a coupling member interposed between the nozzle body and the nozzle cap and having a plurality of micro apertures on a lower inner circumference thereof; and a chamber formed between the nozzle body and the coupling member communicating with the orifices of the nozzle cap and the micro apertures of the coupling member.

2. A spray nozzle as claimed in claim 1, wherein the nozzle body has a female threaded portion formed on an inner circumference of the connecting line, and the nozzle cap has a male threaded portion on a protruded portion thereof, so that the nozzle cap is threadedly engaged to the nozzle body.

* * * * *